US010669782B2

(12) United States Patent
Davis

(10) Patent No.: US 10,669,782 B2
(45) **Date of Patent: *Jun. 2, 2020**

(54) SYSTEM AND METHOD FOR HEATING THE GROUND

(71) Applicant: Michael J. Davis, Ramsey, MN (US)

(72) Inventor: Michael J. Davis, Ramsey, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/537,333

(22) Filed: Aug. 9, 2019

(65) Prior Publication Data

US 2019/0360276 A1 Nov. 28, 2019

Related U.S. Application Data

(63) Continuation of application No. 15/391,634, filed on Dec. 27, 2016, now Pat. No. 10,443,312.
(Continued)

(51) Int. Cl.
*E02D 3/11* (2006.01)
*B09C 1/08* (2006.01)
(Continued)

(52) U.S. Cl.
CPC ..... *E21B 10/44* (2013.01); *E02D 19/00* (2013.01); *E02D 2250/0038* (2013.01)

(58) Field of Classification Search
CPC . E21B 10/44; E02D 19/00; E02D 2250/0038; E02D 3/11; E02D 3/115; B09C 1/06
(Continued)

(56) References Cited

U.S. PATENT DOCUMENTS 944,382 A * 12/1909 Ross ..... E02D 3/11 405/131
1,339,036 A 5/1920 Miles
(Continued)

FOREIGN PATENT DOCUMENTS

| | | |
|---|---|---|
| CA | 208350 | 8/1921 |
| CA | 2271442 | 5/2000 |
| JP | S5948521 | 3/1984 |

OTHER PUBLICATIONS

"ARi announces AerOpak mineral-insulated (MI) thermocouple cable"; Nov. 30, 2010, https://www.automation.com/products/ari-announces-aeropak-mineral-insulated-mi-thermocouple-cable) (Year : 2010).*

*Primary Examiner* — Benjamin F Fiorello
*Assistant Examiner* — Edwin J Toledo-Duran
(74) *Attorney, Agent, or Firm* — Merchent & Gould P.C.

(57) ABSTRACT

A frost removal system is for thawing frozen ground and a method removes frost from a selected area of frozen ground. The method can include providing at least one heat transfer device; auguring a hole into the frozen ground to at least a depth of the frost. The at least one heat transfer device is lowered into the selected area of frozen ground and self-augured to the predetermined depth. The at least one heat transfer device is heated and the heat is allowed to travel along a length of the at least one heat transfer device. Heat is applied from the at least one heat transfer device for thawing the selected area of frozen ground until the frost is removed. The removal system may also be used to remove moisture from saturated soil and to bake columns of soil with increased load-bearing capacity.

16 Claims, 20 Drawing Sheets

Related U.S. Application Data

(60) Provisional application No. 62/271,908, filed on Dec. 28, 2015.

(51) Int. Cl.
*E21B 10/44* (2006.01)
*E02D 19/00* (2006.01)

(58) Field of Classification Search
USPC ..... 405/130, 131
See application file for complete search history.

(56) References Cited

U.S. PATENT DOCUMENTS 1,390,457 A 9/1921 Moran
2,203,881 A * 6/1940 Schwab ..... E02D 3/12 405/263
2,446,387 A * 8/1948 Peterson ..... H01B 9/02 174/105 SC
3,293,863 A * 12/1966 Cox ..... E02F 5/30 405/131
3,578,952 A * 5/1971 Boose ..... H05B 3/50 219/540
3,638,433 A * 2/1972 Sherard ..... E02D 1/04 405/50
3,840,068 A * 10/1974 Waters ..... E02D 3/115 165/45
3,993,860 A * 11/1976 Snow ..... H01B 7/041 174/69
4,061,197 A * 12/1977 Skidmore, Jr. ..... E21B 4/14 175/101
4,370,534 A * 1/1983 Brandon ..... A01M 1/226 219/695
5,181,655 A 1/1993 Bruckelmyer
5,181,797 A * 1/1993 Circeo, Jr. ..... E02D 3/11 405/128.65
5,251,700 A * 10/1993 Nelson ..... B09C 1/06 166/305.1
5,449,113 A 9/1995 Bruckelmyer
5,558,463 A 9/1996 Geisel
5,623,986 A * 4/1997 Wiggs ..... F24T 10/15 165/45
5,649,690 A * 7/1997 Kilmer ..... E04H 12/2223 248/156
5,980,446 A * 11/1999 Loomis ..... B09B 1/00 405/129.45
6,023,052 A * 2/2000 Carl, Jr. ..... G05D 23/1913 219/483
6,056,057 A * 5/2000 Vinegar ..... E21B 36/025 166/272.1
6,079,499 A * 6/2000 Mikus ..... E21B 36/025 166/303
6,632,047 B2 10/2003 Vinegar et al.
9,259,770 B2 * 2/2016 Thomas ..... F23G 5/50
2002/0018697 A1 2/2002 Vinegar et al.
2004/0118615 A1 * 6/2004 Beach ..... E21B 10/44 175/394
2005/0232700 A1 * 10/2005 Timmerman ..... E02D 5/765 405/31
2006/0201179 A1 * 9/2006 Kidwell ..... C10L 3/10 62/260
2007/0023163 A1 * 2/2007 Kidwell ..... F25B 30/06 165/45
2007/0284108 A1 * 12/2007 Roes ..... E21B 36/04 166/302
2008/0078551 A1 * 4/2008 DeVault ..... E21B 36/02 166/302
2010/0129157 A1 * 5/2010 Reddy ..... A01M 17/002 405/128.7
2010/0200192 A1 * 8/2010 Consigny ..... E02D 5/56 165/45
2010/0218912 A1 * 9/2010 Lawless ..... C09K 8/467 165/45
2010/0232881 A1 * 9/2010 Carter, Jr. ..... E02D 19/16 405/55
2011/0238362 A1 * 9/2011 Kidwell ..... F24T 10/17 702/136
2012/0175077 A1 * 7/2012 Lehmann ..... E21B 17/046 165/45
2012/0288332 A1 * 11/2012 Thomas ..... F23C 99/006 405/128.6
2013/0312950 A1 * 11/2013 Shaikh ..... E21B 43/243 166/59
2014/0110082 A1 * 4/2014 Suver ..... F24T 10/17 165/45
2015/0016893 A1 1/2015 Suver et al.
2015/0334781 A1 * 11/2015 Verhagen ..... H05B 6/101 219/667
2017/0051569 A1 * 2/2017 Haworth ..... E21B 21/16
2017/0356280 A1 * 12/2017 Sylvester ..... E21B 33/12
2018/0339324 A1 * 11/2018 Reyes ..... B09C 1/065

* cited by examiner

SYSTEM AND METHOD FOR HEATING THE GROUND

TECHNICAL FIELD

The present disclosure relates generally to a frost and moisture removal system and method for use in connection with removing ground frost in cold weather conditions and for removing moisture from soaked ground. The frost removal system has particular utility in connection with thawing freezing ground for construction projects. Principles applicable to frost removal systems are disclosed which provide heating options accommodating a direct approach. An embodiment is described in the context of a frost removal system for direct use in the ground frost.

BACKGROUND

In northern climates, numerous challenges are presented to the construction industry including frozen ground. Typically for outdoor construction projects, it is necessary to enter frozen ground to reach sub-surface levels. During cold winter months, it can be very difficult to dig holes, trenches, concrete footings, construction pile holes, highway roads, and other cavities in the ground. Usually, it is desirable to thaw the ground before digging construction operations begin.

There are a number of devices and methods used to address ground-freezing problems. In many frost removal systems, a top down approach has been used to remove the frost or thaw the ground. One general type of solution is to place rubber heated water lines across the ground surface and cover the lines with blankets to thaw the ground surface. In such a solution, warm water is circulated through the rubber lines. Another general type of approach to thaw the ground surface is to use direct fire propane or infrared box heaters to heat the ground surface. These methods are expensive and time consuming and often cause up to several weeks of completion for thaw. Such methods may cause collateral damage as materials that are less tolerant to heat such as vinyl windows, polyvinyl chloride (PVC) plumbing components and sheet rock. Moreover, these methods are inefficient as heat rises and 85% of the heat may be lost to the atmosphere rather than being transferred to the frozen ground. Therefore, insulating layers may be needed to retain more of the heat.

In addition, ground may become water logged due to excess water from extreme rainfall, flooding, broken pipes or other sources. In some locations, saturated soil may not cause any problems and excess water may simply be left until the water evaporates, flows away or the water table eventually drops to a lower level. However, for some situations, it may not be possible for the increased water volume to naturally subside. Although in some locations, it may be possible to pump out some of the water; it is not always possible to pump the water out. Moreover, pumping is often only able to get rid of some of the excess water. In some circumstances, it may be necessary to remove the saturated soil and replace with sand or other more suitable fill materials.

It can be seen that improvements in frost and moisture removal systems and methods, are desirable. Such a system and method should have improved efficiency and provide for faster frost and moisture removal than is possible with prior systems and have a wide range of applications. The present invention addresses these needs for removing frost and/or excess water from soil.

SUMMARY OF THE INVENTION

Frost removal systems and features thereof are described. Also described are methods of assembly and use. The present disclosure relates to methods and techniques of thawing frozen ground using an electric screw plug heater. The electric screw plug heater is placed about four feet in the frozen ground such that heat can be applied directly to the frozen ground.

One aspect of the present disclosure relates to a method of removing frost from a selected area of frozen ground. The method can include the step of providing at least one heat transfer device, the at least one heat transfer device having a top and a bottom when in use. The method can include the step of auguring a hole into the selected area of frozen ground to a predetermined depth where the predetermined depth is at least a depth of the frost. The method can further include the step of lowering the at least one heat transfer device into the selected area of frozen ground and self-auguring the at least one heat transfer device to the predetermined depth. The method can include the step of heating the at least one heat transfer device and allowing the heat to travel along a length of the at least one heat transfer device. The method can include the step of applying, for a selected period of time, heat from the at least one heat transfer device for thawing the selected area of frozen ground until the frost is removed.

Another aspect of the present disclosure relates to a method of removing water/moisture frost from a selected area of saturated ground. The method can include the step of providing at least one heat transfer device, the at least one heat transfer device having a top and a bottom when in use. The method can include the step of auguring a hole into the selected area of saturated ground to a predetermined depth where the predetermined depth is at least a depth of the excess water. The method can further include the step of lowering the at least one heat transfer device into the selected area of saturated ground and self-auguring the at least one heat transfer device to the predetermined depth. The method can include the step of heating the at least one heat transfer device and allowing the heat to travel along a length of the at least one heat transfer device. The method can include the step of applying, for a selected period of time, heat from the at least one heat transfer device for heating the selected area of saturated ground to dry the soil until at least the excess water/moisture is removed. Moreover, for certain types of soil, such as clay, heating may increase the structural integrity and load bearing capacity. For such soils, the heating acts to bake the clay so that it cures and hardens. With a vertical heating element, hard baked clay columns capable of load bearing may be formed and provide for improved building properties at the site.

An additional aspect of the present disclosure relates to a ground thawing and boring apparatus that can include a heat transfer device adapted to transfer heat and to thaw a selected area of frozen ground. The heat transfer device can include a hollow tubular member having a first end, an opposite second end, and an elongated shaft between the first and second ends. The heat transfer device also can include a connecter positioned at the first end of the hollow tubular member for connecting a power source. The heat transfer device can include continuous helical flighting that is attached to the hollow tubular member. The helical fighting can extend outwardly from the hollow tubular member to self-auger the hollow tubular member in the selected area of frozen ground. The heat transfer device can also include a heat source positioned within the hollow tubular member. The ground thawing and boring apparatus can further include a controller that coordinates heat from the heat source. The controller can be configured to monitor and adjust temperature of the heat source.

A further aspect of the present disclosure relates to a ground thawing system including a plurality of spaced apart heat transfer devices adapted to transfer heat and to thaw a selected area of frozen ground. Each of the heat transfer devices can include a hollow tubular member having a first end, an opposite second end, and an elongated shaft between the first and second ends; a connecter positioned at the first end of the hollow tubular member for connecting a power source. The heat transfer devices can include continuous helical flighting that is attached to the hollow tubular member. The helical fighting can extend outwardly from the hollow tubular member to self-auger the hollow tubular member in the selected area of frozen ground. The heat transfer device can also include a heat source positioned within the hollow tubular member. The system can further include a controller coordinating heat from the heat source. The controller can be configured to monitor and adjust temperature of the heat source.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION

Figure 1:
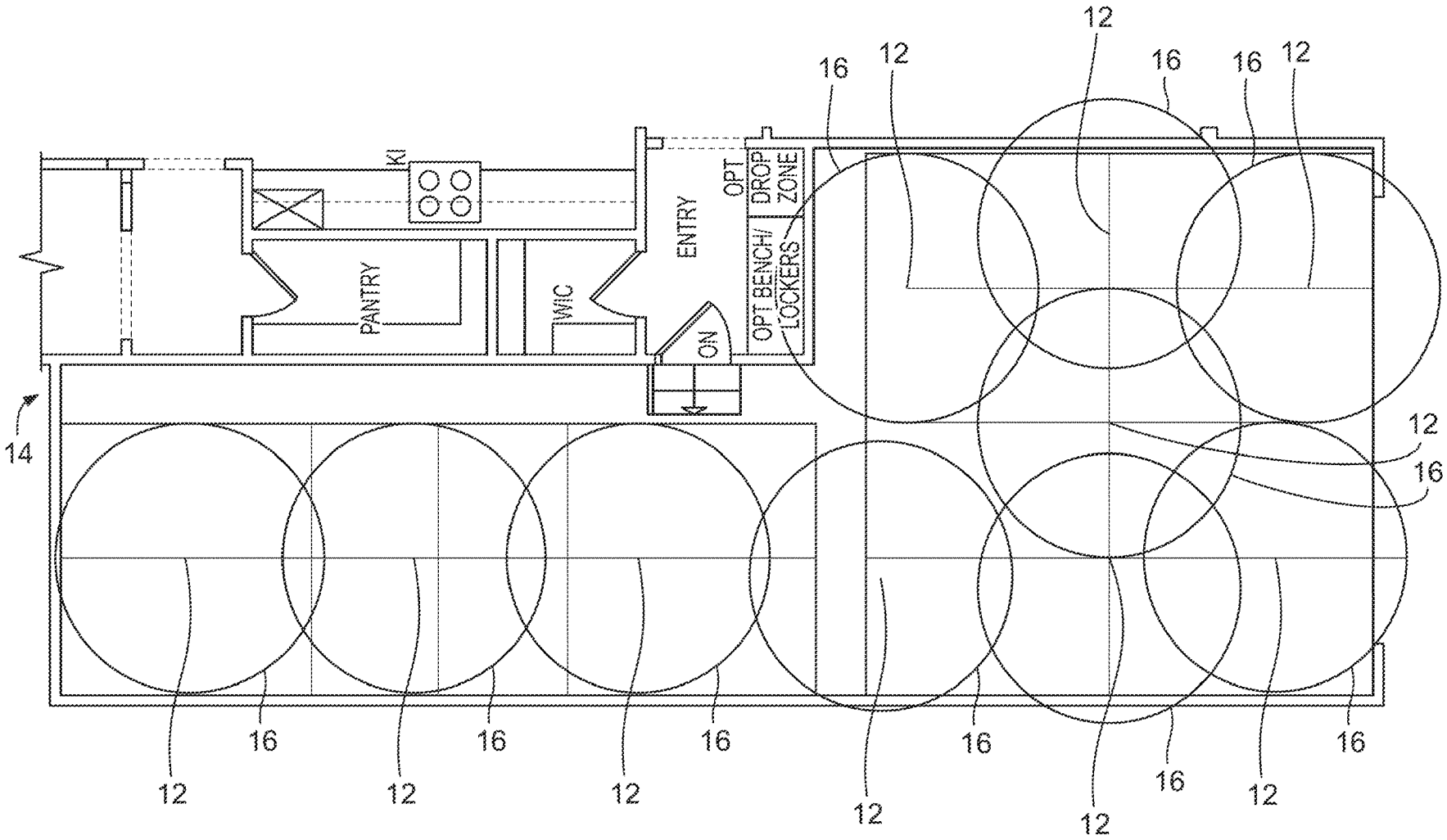
FIG. 1 is a top view of a heating system showing a pattern of a plurality of heaters placed in a ground according to the principles of the present invention.

Referring to FIG. 1, a heating system 10 showing a pattern of a plurality of heaters 12 (e.g., heat transfer device) placed in a ground of an existing building foundation 14 is illustrated. As depicted, each one of the plurality of heaters 12 have a heating zone area 16 displayed by respective circles to create a heating zone layout. In one embodiment, the heating zone area 16 of each one of the plurality of heaters 12 is about 10 feet, alternatives are possible.

Figure 2:
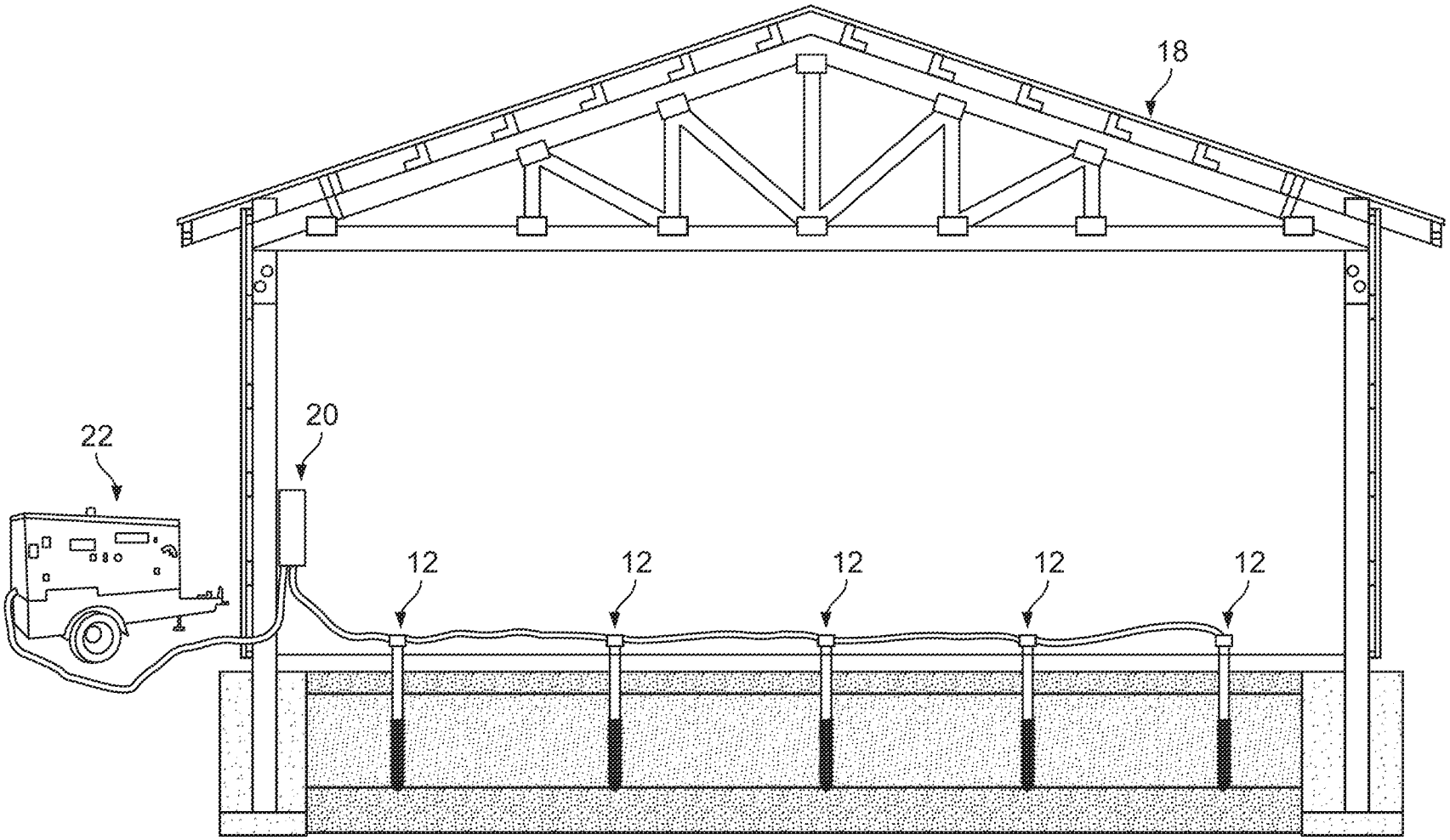
FIG. 2 is a side cross-sectional view of a building with the heating system shown in FIG. 1.
Figure 4:
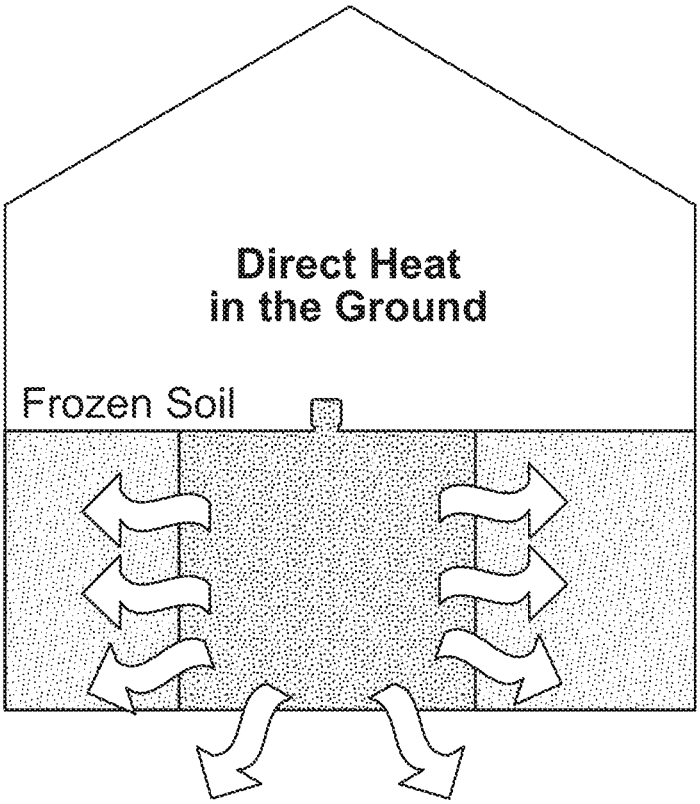
FIG. 4 is a side sectional diagrammatic view of a building with a single heater and heat radiating from the heater according to the principles of the present invention.

Referring to FIG. 2 and FIG. 4, a side cross-sectional view of a building 18 is shown including the heating system 10. In FIG. 2 the plurality of heaters 12 is shown positioned spaced apart and adjacent to one another in the foundation of the building 18. The plurality of heaters 12 are arranged and configured to provide a heat source for thawing frozen ground. In one embodiment, the plurality of heaters 12 includes a controller 20 for monitoring and adjusting power and temperature. A portable generator 22 may be used to power the plurality of heaters 12. For some configurations the generator 22 is mounted on a trailer and towed to the work site. The controller 20 may also be mounted on the trailer. The controller 20 is illustrated and described in more detail with reference to FIG. 14. FIG. 4 shows that the heat radiates from the heater 12 downward and radially outward into the surrounding soil and thaws the volume around each heater 12.

Figure 20:
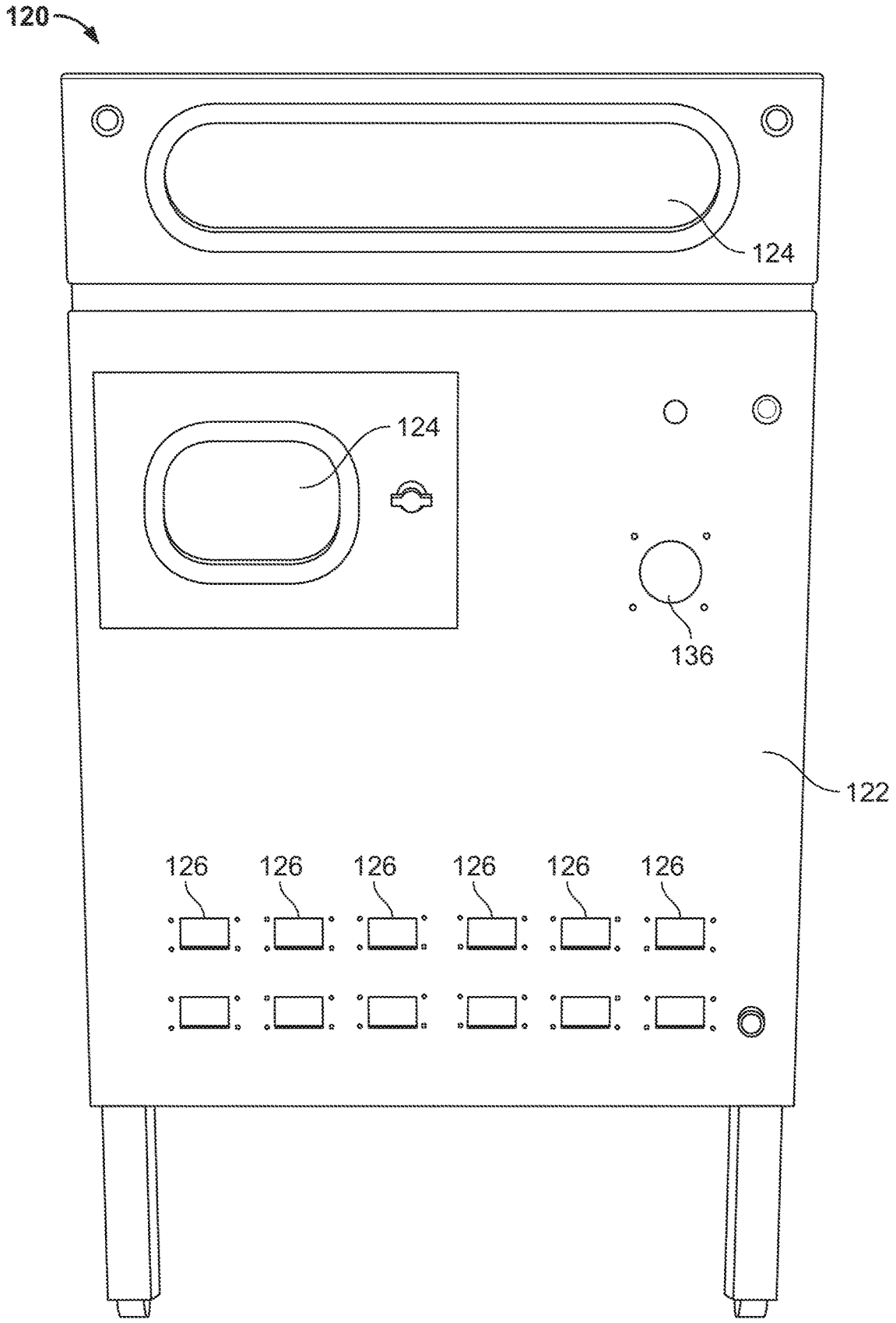
FIG. 20 is a front elevation view of a portable controller for the heating system of FIG. 1.
Figure 21:
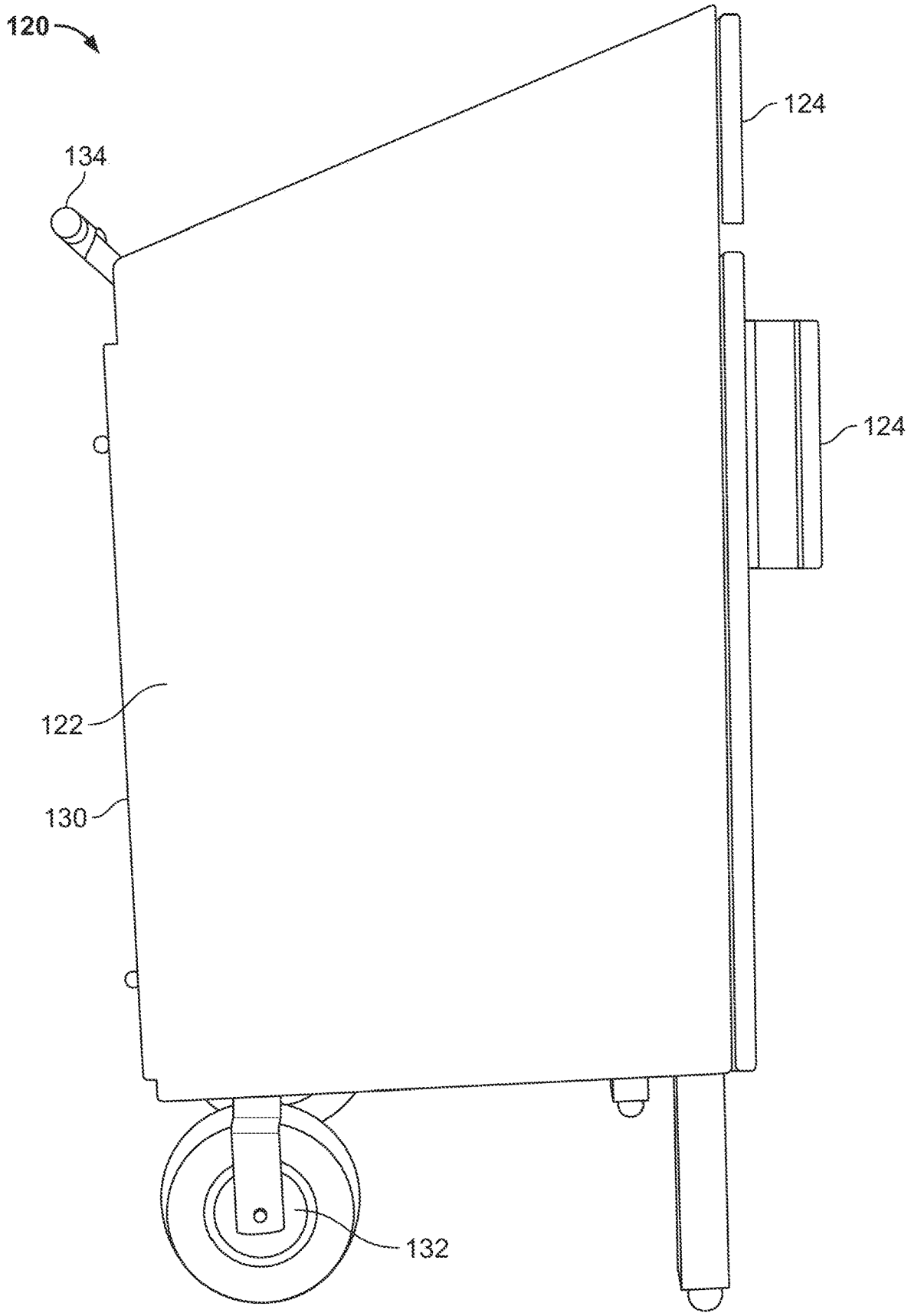
FIG. 21 is a side elevational view of the portable controller shown in FIG. 20.

For some sites, a generator trailer may not be used and a portable controller 120 is needed, such as shown in FIGS. 20 and 21. The portable controller 120 is UL rated and includes a housing 122 containing control circuits, boards and modules. The portable controller includes switches 126 and displays 124 that show outputs related to monitor energy usage, processing time, temperatures, moisture content and other variables. A rear access panel 130 opens to provide access to the inner components. The portable controller 120 is mounted on wheels 132 and a handle 134 for easy transport. The portable controller 120 includes a plug 136 to connect to power and to the plurality of heaters 12.

Figure 3:
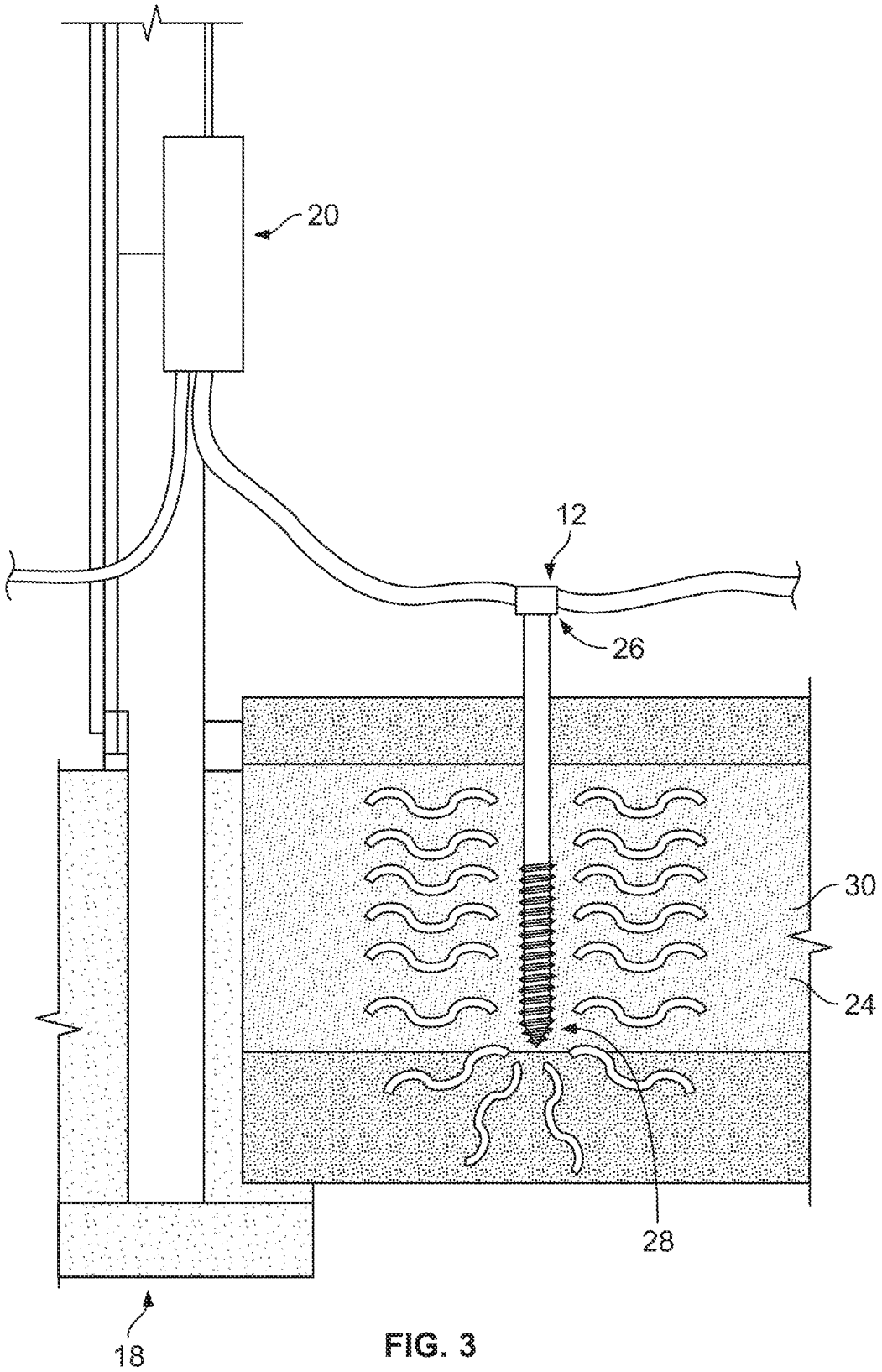
FIG. 3 is a detail view of one of the heaters for the heating system shown in FIGS. 1 and 2.

Referring to FIG. 3, a detail view of one of the plurality of heaters 12 for the heating system 10 is shown. The heater 12 is configured to apply heat to a selected area of frozen ground 24 for a selected period of time until frost is removed. The heater 12 includes a top 26 and a bottom 28 when in use.

In one embodiment, a method for removing frost from a selected area of frozen ground 24 includes auguring a hole into the selected area of frozen ground 24 to a predetermined depth. In certain examples, the predetermined depth is about four feet, although alternatives are possible. In other examples, the predetermined depth is at least a depth of the frost. The method can include lowering at least one of the plurality of heaters 12 into the hole of the selected area of frozen ground 24. In certain examples, rather than auger holes first then insert the plurality of heaters 12, the plurality of heaters 12 can be directly augured into the frozen ground. In one embodiment, continuous helical fighting 30 can be attached to each one of the plurality of heaters 12 such that the plurality of heaters 12 can self-adjust/self-auger to the predetermined depth. The continuous helical fighting 30 is illustrated and described in more detail with reference to FIGS. 6 and 7.

The method further includes the step of heating the at least one of the plurality of heaters 12 and allowing the heat to travel along a length $L_1$ (see FIG. 5*a*) of the at least one of the plurality of heaters 12. The method includes the step of applying, for a selected period of time, heat from the at least one of the plurality of heaters 12 for thawing the selected area of frozen ground 24 until the frost is removed.

Figure 5:
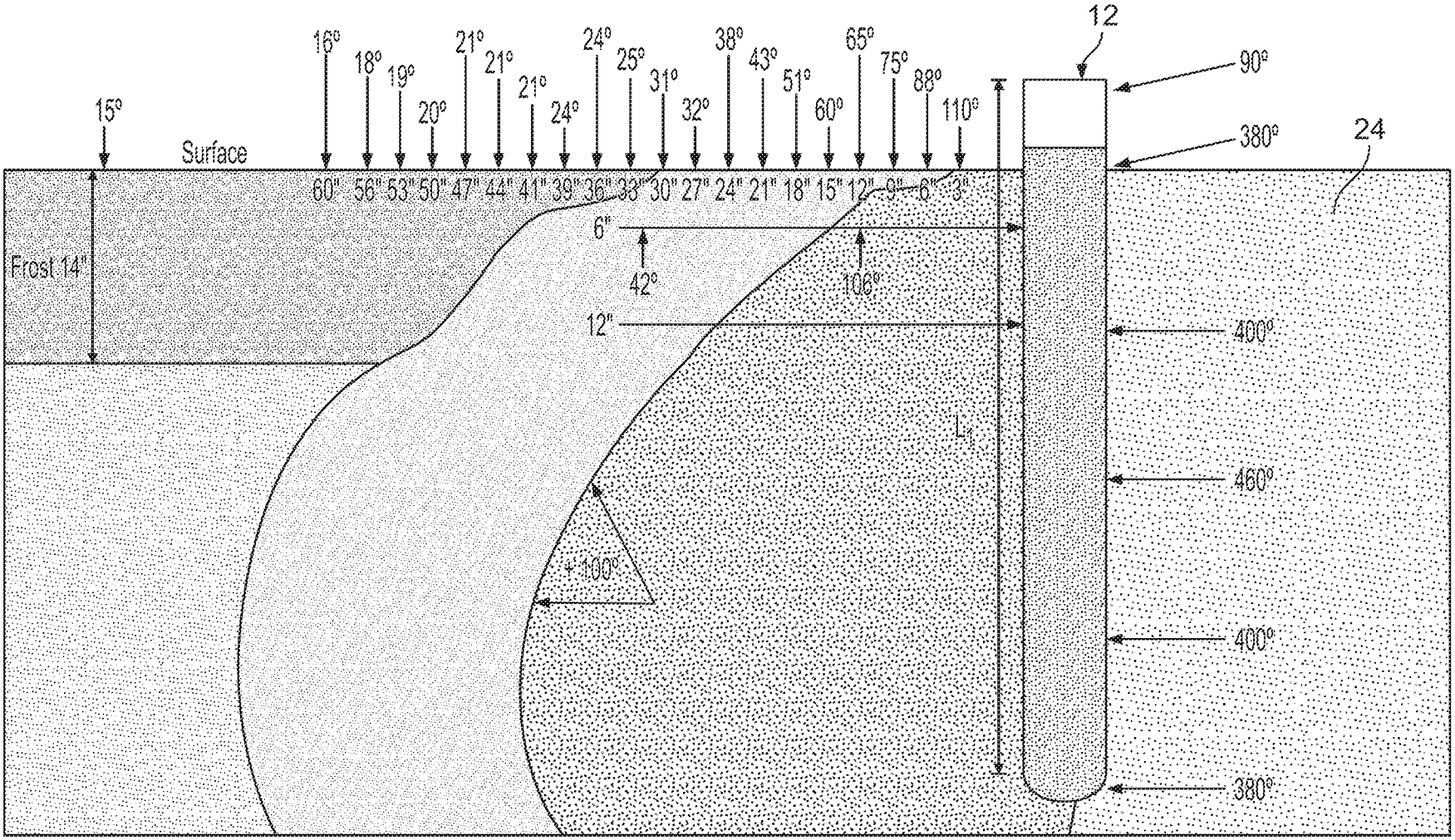
FIG. 5 is a side sectional view showing one of the heaters generating heat and a heat gradient for the ground surrounding the heater.

FIG. 5*a* illustrates a side sectional view showing one of the plurality of heaters 12 generating heat and a heat gradient for the selected area of frozen ground 24 surrounding the one heater 12. In the depicted embodiment, the one heater 12 is positioned about 6 feet into the frozen ground. The temperature setting of the heater 12 was well over about 550° F. The temperature of the one heater 12 was measured along the length $L_1$ thereof and was between 90° F. and 460° F. The heat gradient depicts the temperature data at various depths and the heat increases. The one heater 12 is capable of efficiently heating the selected area of frozen ground 24.

In one embodiment, the plurality of heaters 12 can provide a heat gradient that is measured out to about a 10 foot radius. The plurality of heaters 12 can obtain a complete thaw within 48 hours, which is a substantial improvement over prior methods which can take several weeks for a complete thaw.

In the embodiment provided, the one heater 12 was exposed to open air and the thaw was completed within 48 hours. In other embodiments, blankets can be used to cover the heaters 12 so that they are not exposed in open air, which may decrease the thawing time to be within 24 hours. To help prevent the heater 12 from overheating, the top 6 to 8 inches of the heater 12 includes a cold zone. Typically, the cold zone is about 90° F.

Figure 8:
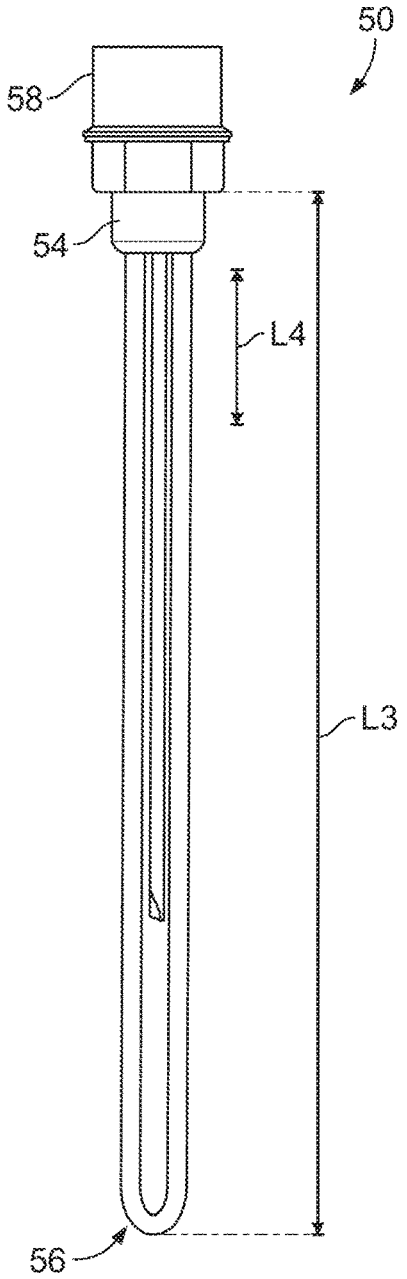
FIG. 8 is a side elevational view of a heating element for the heater of FIG. 3 showing a terminal enclosure on top.

Each one of the plurality of heaters 12 includes a frost tube 32 (e.g., hollow tubular member) and a heating element 50 (e.g. a heat source)(See FIG. 8). The heating element 50 is positioned inside of the frost tube 32. In the depicted embodiment, the frost tube 32 is a metal tube.

Figure 6:
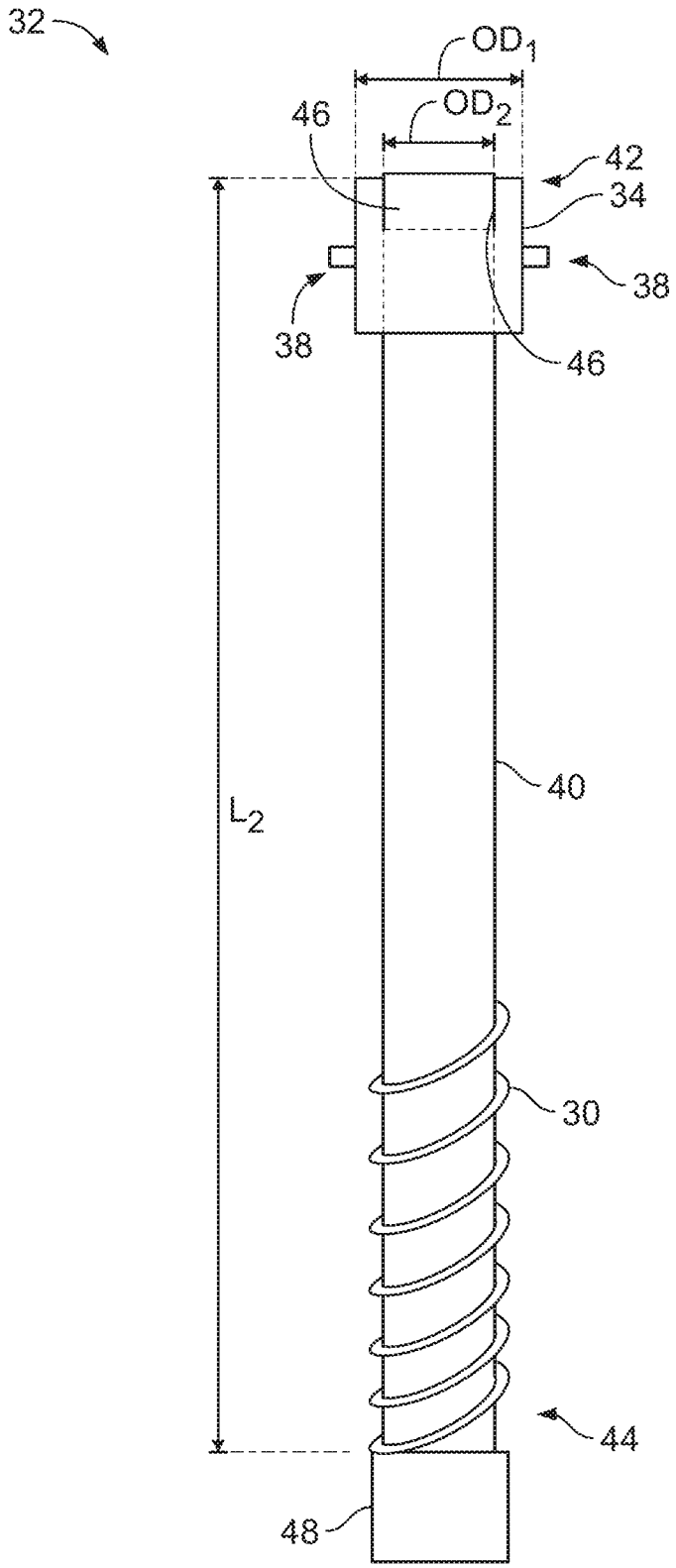
FIG. 6 is a side elevational view of a frost tube of the heater of FIG. 3 showing a collar for a driver.
Figure 7:
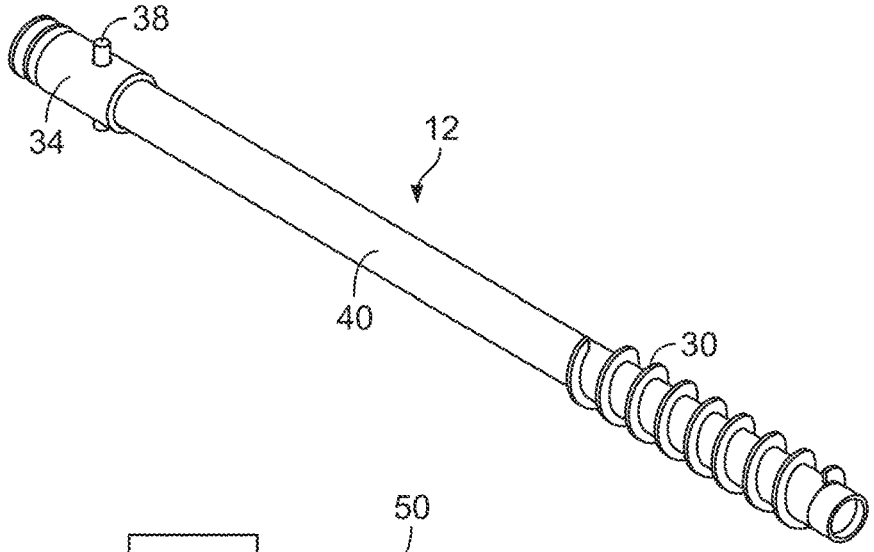
FIG. 7 is a perspective view of the frost tube heater of FIG. 6.

Referring to FIG. 6 and FIG. 7, the frost tube 32 is shown with a collar 34 mounted thereon. The collar 34 is arranged and configured for a driver 36 (see FIG. 10), which drives the heater 12. The collar 34 can be easily mounted by sliding over the heater 12. In one embodiment, the collar 34 is integral with (e.g., formed in one seamless piece with) the heater 12. For example, the collar 34 can be welded to the heater 12, although alternatives are possible. In the depicted embodiment, the collar 34 has an outer diameter $OD_1$ of 4.0 inches and the frost tube 32 has an outer diameter $OD_2$ of 3 inches, alternatives are possible. The collar 34 includes pins 38 on opposite sides thereof. In one embodiment, the pins 38 can extend outwardly from the collar 34 a distance of about 0.75 inches and can be about one inch in width.

The frost tube 32 includes an elongated shaft 40 between a proximal end 42 and a distal end 44 thereof. The proximal end 42 of the shaft 40 includes a 2.5 inch NPT 46 (National Pipe Thread) for threading in the heating element 50. Thus, the heating element 50 is removable and/or replaceable at any time. The heating element 50 is illustrated and described in more detail with reference to FIG. 6 and FIG. 7.

The distal end 44 of the shaft 40 also includes a threaded connection 48 for attaching a rotating carbide bit 52 (e.g., cutter, chisel, pick, tooth, etc.). (See FIG. 12B.) The carbide bit 52 will, by impact force, remove or separate material during digging/drilling operations. The bit 52 can be constructed in a variety of shapes and sizes and include leading impact points or edges. The harsh environment associated with digging and/or drilling virtually guarantees that the bits 52 will wear down over time. Once the leading tips or edges becomes worn or damaged, the bit will need to be replaced. Because of the threaded connection 48, the bit 52 is easily removable and interchangeable.

The helical fighting 30 can be mounted on the shaft 40 of the frost tube 32 by various attachment processes, such as, but not limited to, welding. In one embodiment, the helical fighting 30 extends ¾ inch from the shaft 40 thereby making the total outside diameter of the shaft 40 4.5 inches, alternatives are possible. In one embodiment, the helical flighting 30 has a 2.5 inch pitch, although alternatives are possible.

In the depicted embodiment, the shaft 40 of the frost tube 32 has a length $L_2$; $L_2$ being the length between the proximal and distal ends 42, 44 of the frost tube 32. In one embodiment, $L_2$ is about 57 inches long, although alternatives are possible. The helical fighting 30 can extend along the distal end 44 of the shaft 40 of the frost tube 32 about 10 inches to 15 inches. It will be appreciated that the helical flighting 30 may vary in spacing, angle, width, diameter, and length.

In certain soil conditions, the augured hole may collapse at lower levels or fill such that the at least one of the plurality of heaters 12 may stick too far out of the ground once inserted. In other aspects, if the hole is augured too deep, the at least one of the plurality of heaters 12 may slide too far into the ground and/or may become a challenge to remove. For example, inserting a smooth frost tube into the hole may result in the tube sinking deeper into the ground as the ground starts to thaw, which may cause the electrical connections to rip out. The helical fighting 30 mounted on the frost tubes 32 of the plurality of heaters 12 can help to prevent the issues described above. The helical fighting 30 allows the plurality of heaters 12 to self-auger to a precise depth, which provides for safe installation because the plurality of heaters 12 will not move around as the ground thaws. In other words, the plurality of heaters 12 can self-adjust in the ground the remaining distance to reach the predetermined depth. In one embodiment, the remaining distance can be between one and two feet, although alternatives are possible.

Referring to FIG. 8, a side elevational view of the heating element 50 is shown. The depicted heating element 50 is an electric screw plug heater that is used to heat air inside the frost tube 32 when mounted therein. The heating element 50 provides an efficient, controllable and safe method of heating the frost tubes 32. The heating element 50 includes threaded connections 54 that interface with the pipe thread 46 of the frost tube 32 for screwing the heating element 50 therein. The heating element has a length $L_3$; $L_3$ being the length between the threaded connections 54 and a bottom 56 of the heating element 50. The heating element 50 has a cold zone with a length of $L_4$; $L_4$ being about 6 inches to about 8 inches long, although alternatives are possible.

In the depicted embodiment, a terminal enclosure 58 is mounted directly on top of the heating element 50. The terminal enclosure 58 can be mounted to the heating element 50 by various attachment processes, such as, but not limited to, a mechanical fastener (e.g., bolt)(not shown). The terminal enclosure 58 includes plugins for the heating element 50. In certain embodiments, the terminal enclosure 58 may include a removable cover (not shown) defining an opening for receiving electrical connections 60 (see FIG. 9). The opening may be one inch in diameter for plugging wires into the electrical connection.

Figure 9:
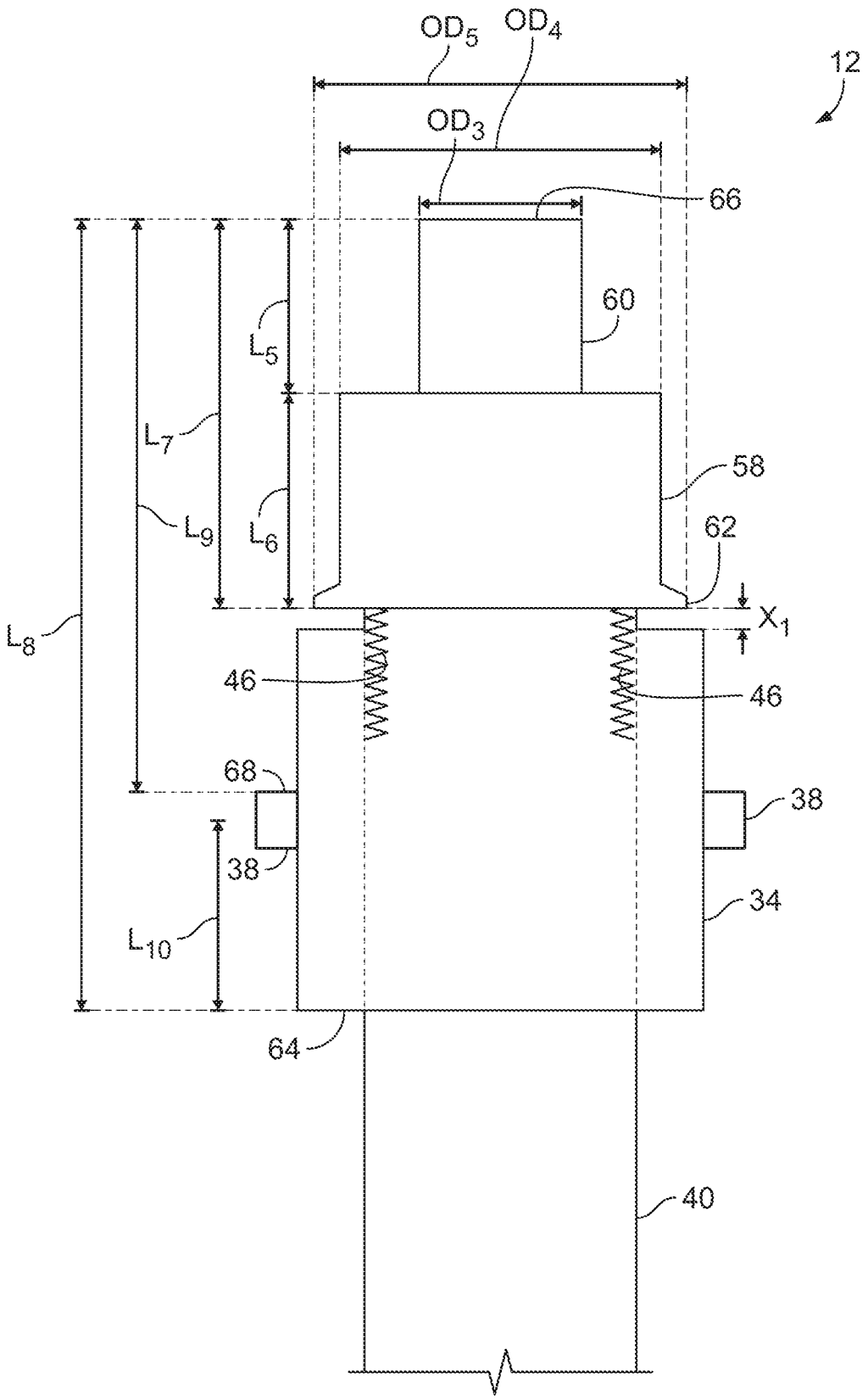
FIG. 9 is a detailed view of a top portion of the heater with the collar and electrical connectors.

Referring to FIG. 9, a detailed view of a top portion of the heater 12 is shown with the collar 34, terminal enclosure 58, and electrical connections 60 attached. The electrical connection 60 can be attached to a top of the cover by a threaded connection. Wires can be plugged into the electrical connection 60 for powering the heating element 50. The electrical connection 60 can be arranged and configured as a quick connect to the controller 20.

The electrical connection 60 has an outer diameter of $OD_3$ and a length $L_5$. The $OD_3$ being about 1.5 inches, although alternatives are possible. The length $L_5$ being about 3.0 inches long, although alternatives are possible.

The terminal enclosure 58 has an outer diameter of $OD_4$ excluding a base 62 of the terminal enclosure 58 and the terminal enclosure 58 has a length $L_6$. The $OD_4$ being about 3.5 inches, although alternatives are possible. The outer diameter $OD_5$ of the terminal enclosure 58 including the base 62 is about 3.63 inches, although alternatives are possible. The length $L_6$ being about 3.0 inches long, although alternatives are possible. Thus, the total length $L_7$ of the electrical connection 60 and the terminal enclosure 58 together as mounted on the collar 34 is about 6 inches.

The heater 12 has a length $L_8$; $L_8$ being the length from a bottom 64 of the collar 34 to a top 66 of the electrical connection 60. In one embodiment, the length $L_8$ is about 10.5 inches long. The heater 12 also includes a length $L_9$ that is defined as being the length from a top 68 of the pins 38 to the top 66 of the electrical connection 60. The length $L_{10}$ is defined as being the length from a mid-section of the pins 38 to the bottom 64 of the collar 34. In certain embodiments, a gap $X_1$ can be defined between the collar 34 and the terminal enclosure 58 for welding purposes. The gap $X_1$ can be about 0.5 inches wide.

Figure 22:
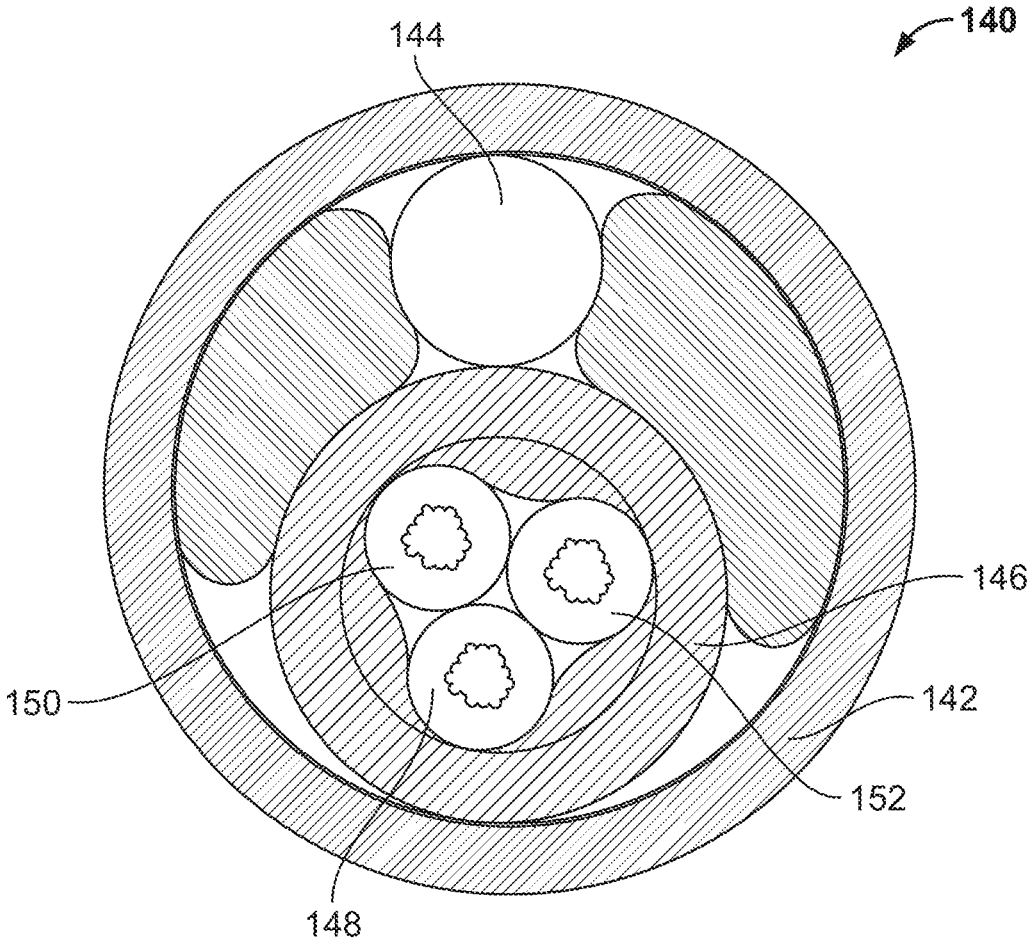
FIG. 22 is a cross-sectional view of a multi-function cable for the frost tube heater shown in FIG. 6.

Referring to FIG. 22, a cross-section of cable 140 used with the heaters 12 is shown. The cable 140 provides protection and separation of multiple components. An outer cover 142 is made of a temperature resistant with good insulating properties such as a thermoplastic elastomer (TPE). The cable 140 encapsulates a thermocouple 144 and a TPE jacket 146 including insulated positive, negative and ground wires 148, 150 and 152. Fillers 154 made of a suitable material, such as polyester, maintain the thermocouple 144 and the jacket 146 in proper position and prevent tangling. The wires 148, 150 and 152 are made of high grade material such as tinned copper (TC). The wires are also separated by a suitable material such as tissue paper 156 in the embodiment shown. A liner or wrap 158 made of Mylar or other suitable material extends the interior of the outer cover. The exterior of the cable 140 is preferably a bright easy to see color so it is easily seen and to minimize damage and a tripping hazard.

Figure 10:
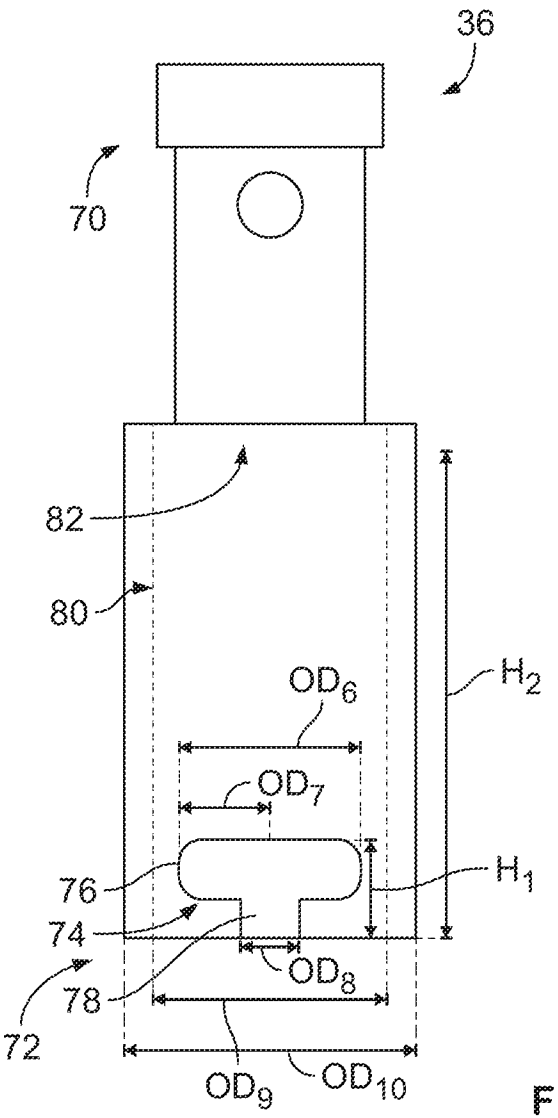
FIG. 10 is a detailed view of a driver complementary to the collar shown in FIG. 9.

Referring to FIG. 10, a detailed view of the driver 36 is shown including an upper end 70 and a lower end 72. The driver 36 is arranged and configured to drive the heater 12. The driver 36 includes generally a T-shaped slot 74 formed in the lower end 72 portion thereof. The T-shaped slot 74 has a cross portion 76 with an outer diameter $OD_6$ where half of the cross portion 76 has an outer diameter $OD_7$. The $OD_6$ can be about 3.5 inches and the $OD_7$ can be about 1.75 inches, although alternatives are possible. The T-shaped slot 74 also includes a base portion 78 that has an outer diameter $OD_8$; $OD_8$ being about 1.125 inches, although alternatives are possible. The T-shaped slot 74 can extend from the lower end 72 of the driver 36 a height $H_1$; $H_1$ being about 3.0 inches in height. The driver 36 has an inner drive shaft sleeve 80 with a diameter $OD_9$; $OD_9$ being about 4.0 inches, although alternatives are possible. The inner drive shaft sleeve 80 has a height $H_2$; $H_2$ being the height from the lower end 72 of the driver 36 to a closed end 82 of the inner drive shaft sleeve 80. The height $H_2$ being about 12 inches, although alternatives are possible. The driver 36 has an outer diameter $OD_{10}$; the $OD_{10}$ being about 5.0 inches, although alternatives are possible.

Figure 11:
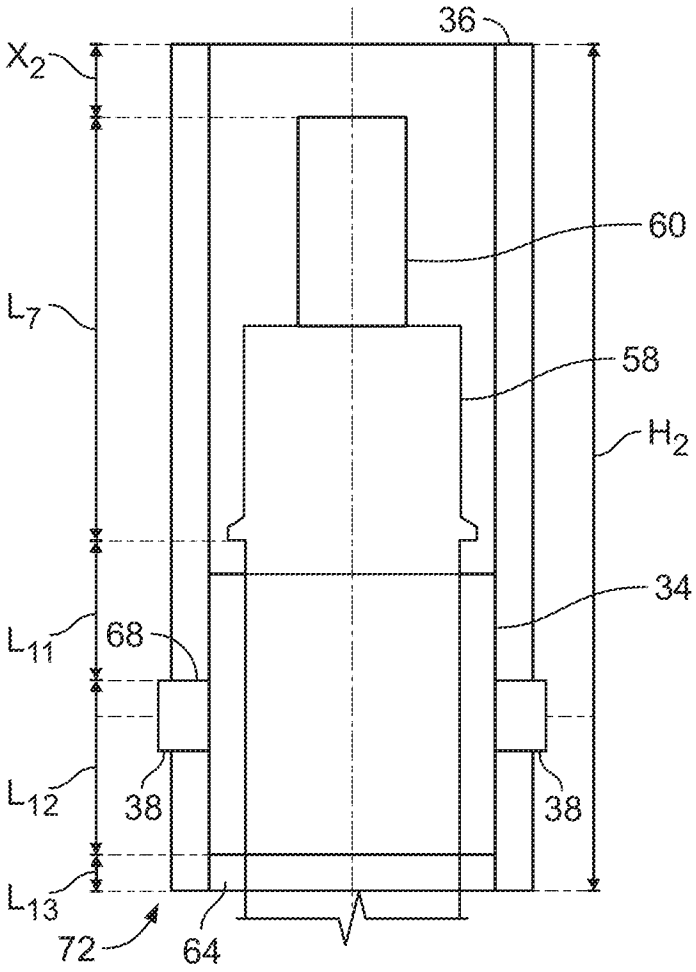
FIG. 11 is a side cross-sectional view showing the driver mounted to the collar.

FIG. 11 is a side cross-sectional view showing the driver 36 mounted over the collar 34. The heater 12 including the electrical connection 60, the terminal enclosure 58, and the collar 34 are received within the inner drive shaft sleeve 80 of the driver 36. The pins 38 of the collar 34 are received in the cross portion 76 of the T-shaped slot 74 to lock the driver 36 thereon. In certain embodiments, 6 inches of the heater 12 is extending out of the ground so that the driver 36 can be mounted thereon. Once the driver 36 is mounted, a gap $X_2$ is shown between the electrical connection 60 and the upper end 70 of the driver 36. The gap $X_2$ can be about 1 inch in length. A length $L_{11}$ is defined as being the length from the top 68 of the pins 38 to the base 62 of the terminal enclosure 58. The length $L_{11}$ being about 2.0 inches, although alternatives are possible. A length $L_{12}$ is defined as being the length from top 68 of the pins 38 to the bottom 64 of the collar 34. The length $L_{12}$ being about 2.5 inches, although alternatives are possible. A length $L_{13}$ is defined as being the length from the bottom 64 of the collar 34 to the lower end 72 of the driver 36. The length $L_{13}$ being about 0.5 inches, although alternatives are possible.

Figure 12A:
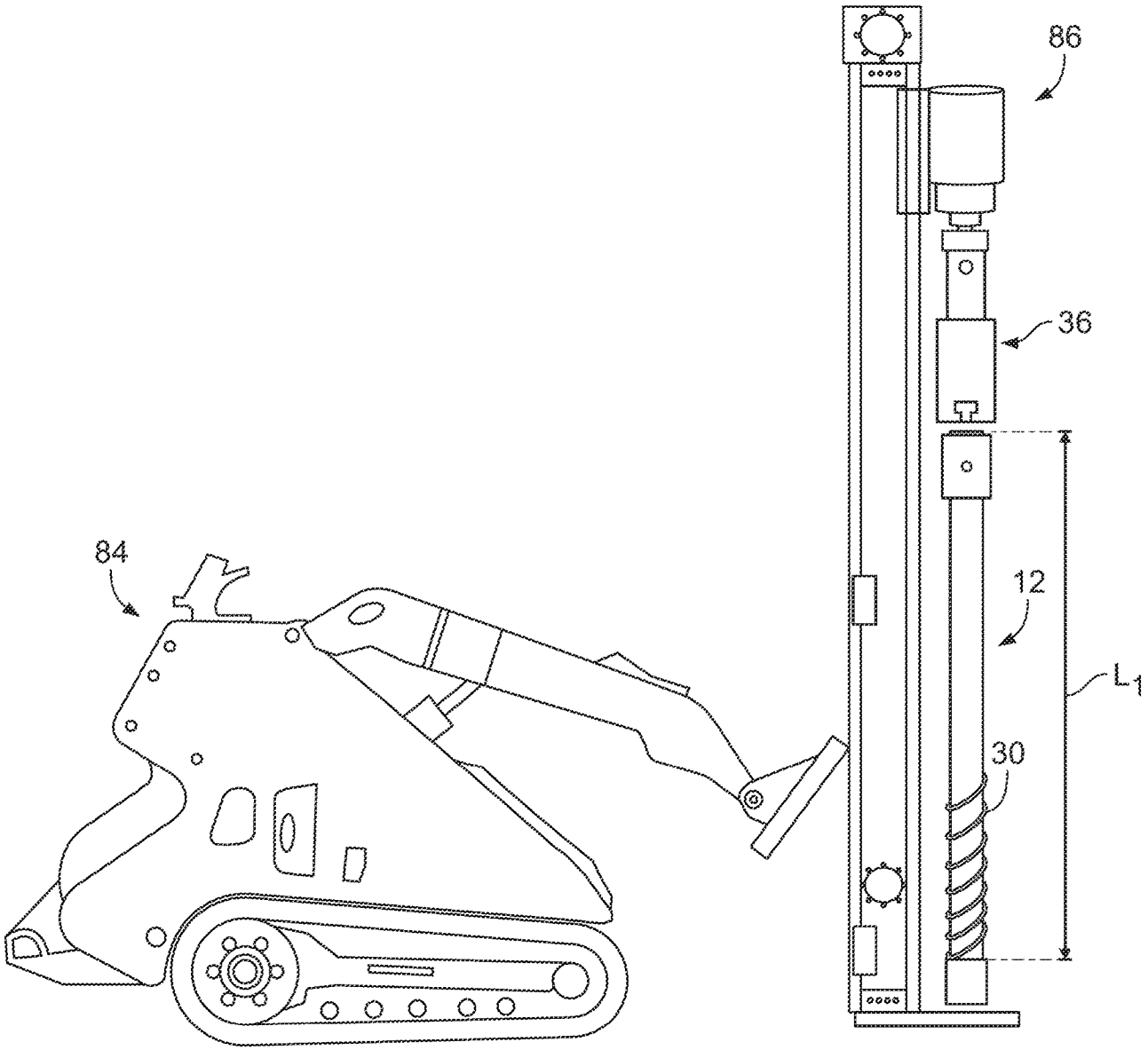
FIG. 12A is a side perspective view of a skid steer vehicle with a drilling assembly mounted thereto.
Figure 12B:
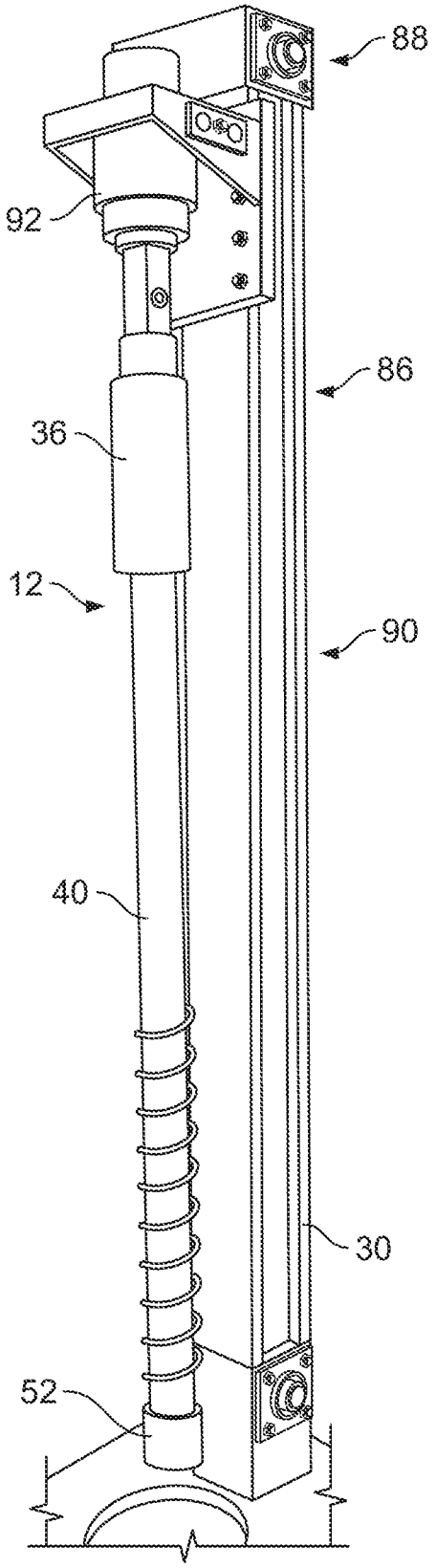
FIG. 12B is a front perspective view of the heater with a cutting bit mounted thereon.

Referring to FIG. 12A, a side perspective view of a skid steer vehicle 84 is shown with a drilling assembly 86 mounted thereto. FIG. 12B shows a front perspective view of the heater 12 with the bit 52 mounted thereon. The drilling assembly 86 is a hydraulic driller configured to apply the hydraulic power and down force desired for drilling. In one embodiment, 12,000 lbs. to 15,000 lbs. of downward pressure can be applied by the drilling assembly 86. The compact size and power of the drilling assembly 86 can provide for a safe installation and removal of the heaters 12 from the ground.

Figure 13A:
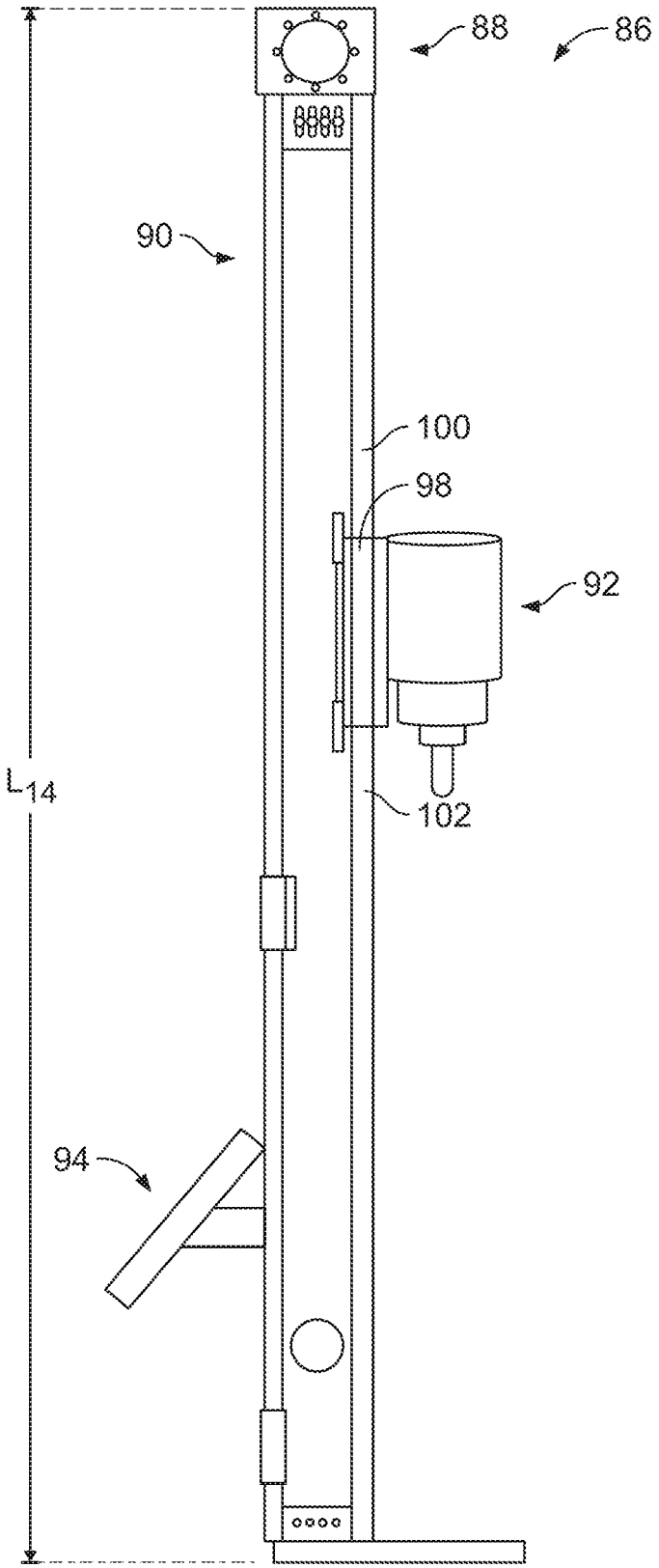
FIG. 13A is a side view of the drilling assembly shown in FIG. 12A without the heater of FIG. 3.
Figure 13B:
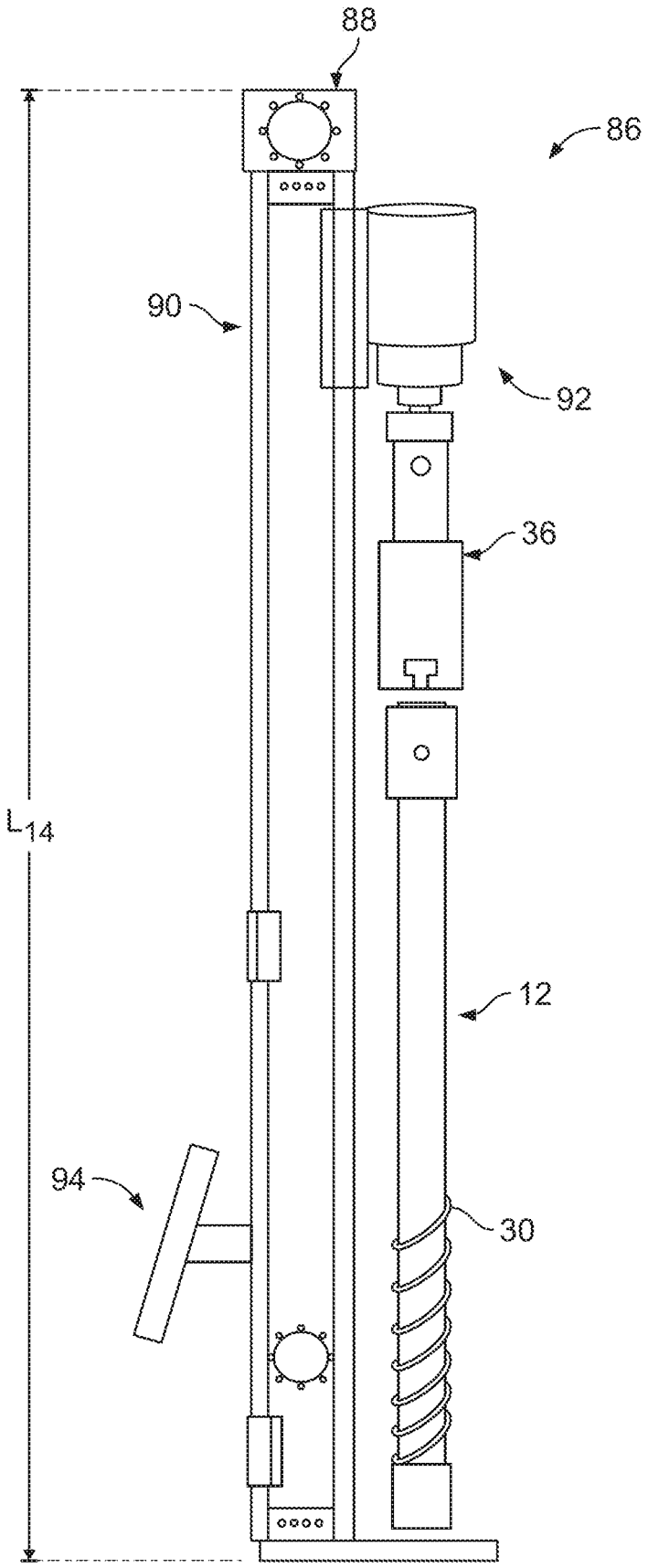
FIG. 13B is a side view of the drilling assembly shown in FIG. 12A.
Figure 14:
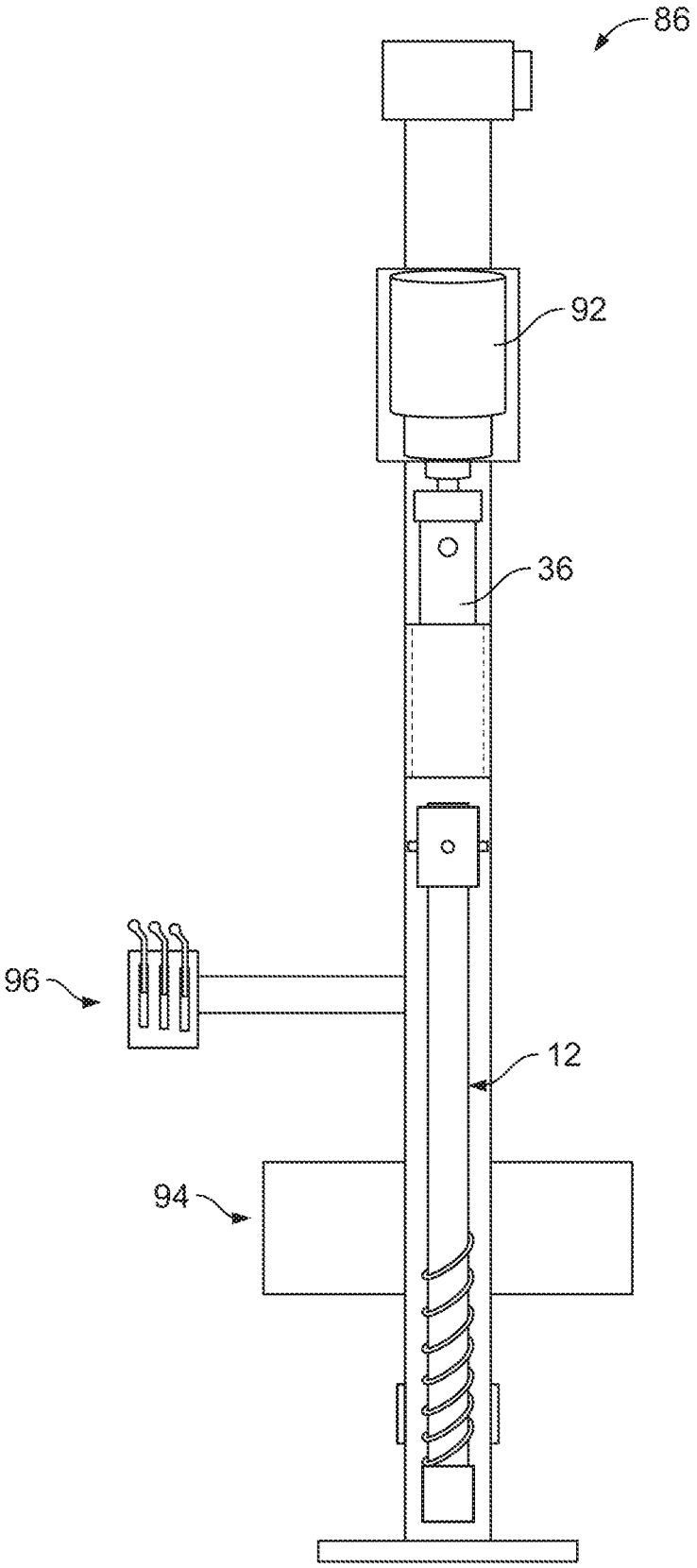
FIG. 14 is a front view of the drilling assembly shown in FIG. 12A.

Referring to FIGS. 13A, 13B, and 14, side and front views of the drilling assembly are shown. The drilling assembly includes a length $L_{14}$; $L_{14}$ being about 8.5 feet. The drilling assembly 86 includes a hydraulic chain drive 88, I-beam mast 90, hydraulic auger motor 92, a skid mount 94, and a hydraulic controller bank 96. The skid mount 94 is shown mounted directly to the I-beam mast 90 and the skid steer vehicle 84 can be mounted to the skid mount 94. The driver 36 is arranged and configured to fit in the hydraulic auger motor 92 for driving the heater 12 (see FIG. 12B). Hydraulic flow is used to run the hydraulic auger motor 92, which achieves the proper down force to auger the plurality of heaters 12 into the frozen ground.

In the depicted embodiment, the hydraulic auger motor 92 is attached to a mounting plate 98. The hydraulic chain drive 88 is attached to a top side 100 of the mounting plate 98 and a bottom side 102 of the mounting plate 98 to move the mounting plate up and down the I-beam mast 90. The hydraulic chain drive 88 can be attached to the mounting plate 98 with adjustable screws, although alternatives are possible. The hydraulic chain drive 88 is a dual chain running within the I-beam mast 90. Thus, both sides of the I-beam mast 90 include dual chains running therein. The dual chain applies equal force to the mounting plate 98 as it is moved up and down the I-beam mast 90. The hydraulic auger motor 92 slides up and down the I-beam mast 90 with the mounting plate 98. The hydraulic chain drive 88 provides the hydraulic power or down pressure needed to dig or auger the ground. The hydraulic controller bank 96 can be used to control the drilling assembly 86.

Figure 15:
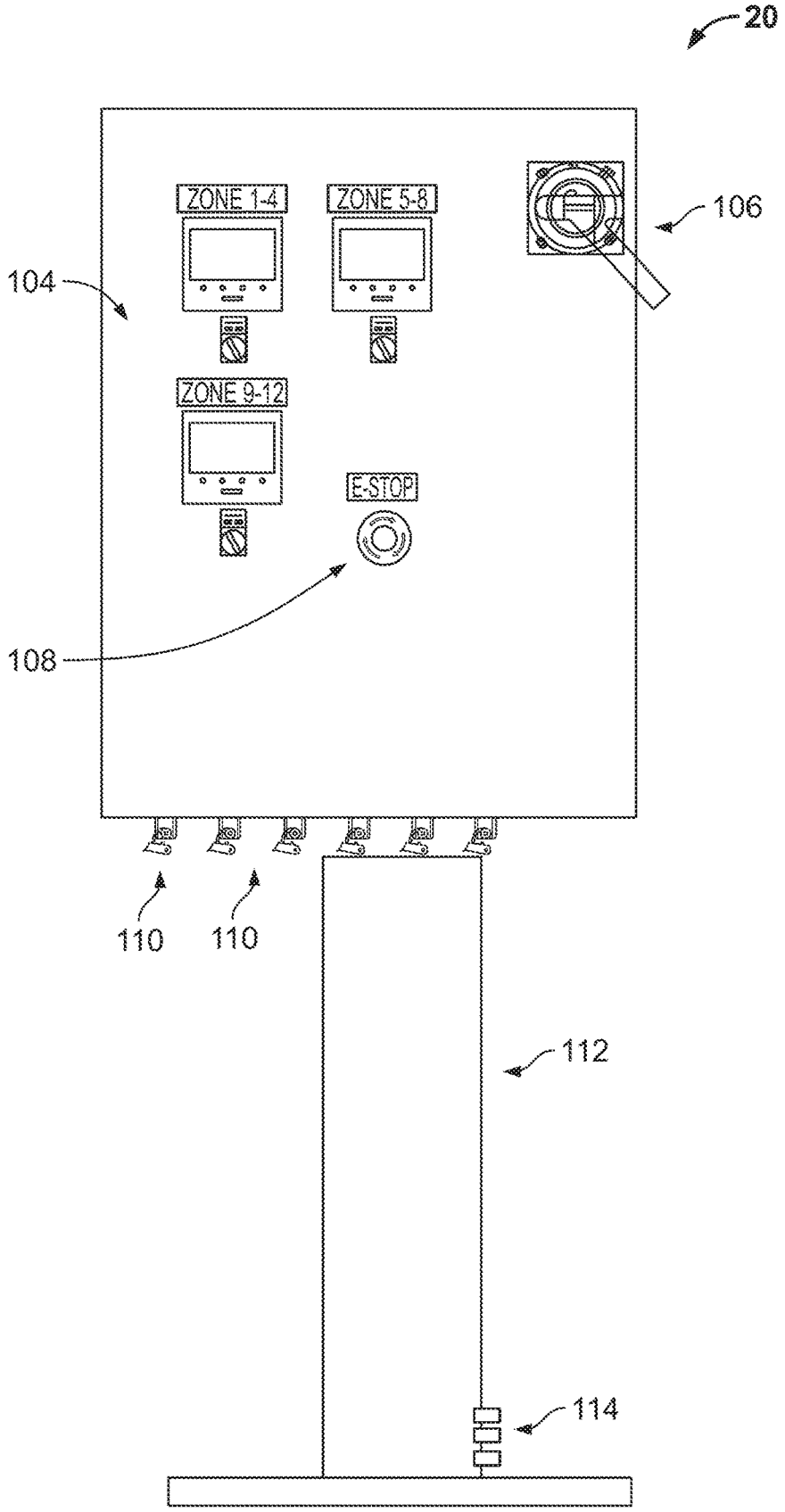
FIG. 15 is a schematic of a controller for the heating system of FIG. 1.

Referring to FIG. 15, a schematic of the controller 20 is shown for the heating system 10. The controller 20 includes computer zone controllers 104, a power disconnect 106, an emergency shut off 108, sealed connectors 110, a pedestal mount 112, and sealed power lugs 114. The controller 20 is designed to control and power 1500 watt electric heaters in a series of twelve. The controller 20 can be configured to provide portal power during the initial start-up and then can switch to house current for generating power. The controller 20 fully monitors and controls heating of the plurality of heaters 12.

In certain embodiments, the controller 20 controls the interaction of the heaters 12 between each other. The controller 20 can control the temperature of the 12 heaters based the distances between the heaters 12, the duration of the heat applied, and the determined time to switch to houses current. It will be appreciated that other aspects of controlling the heaters 12 may be involved.

Figure 16:
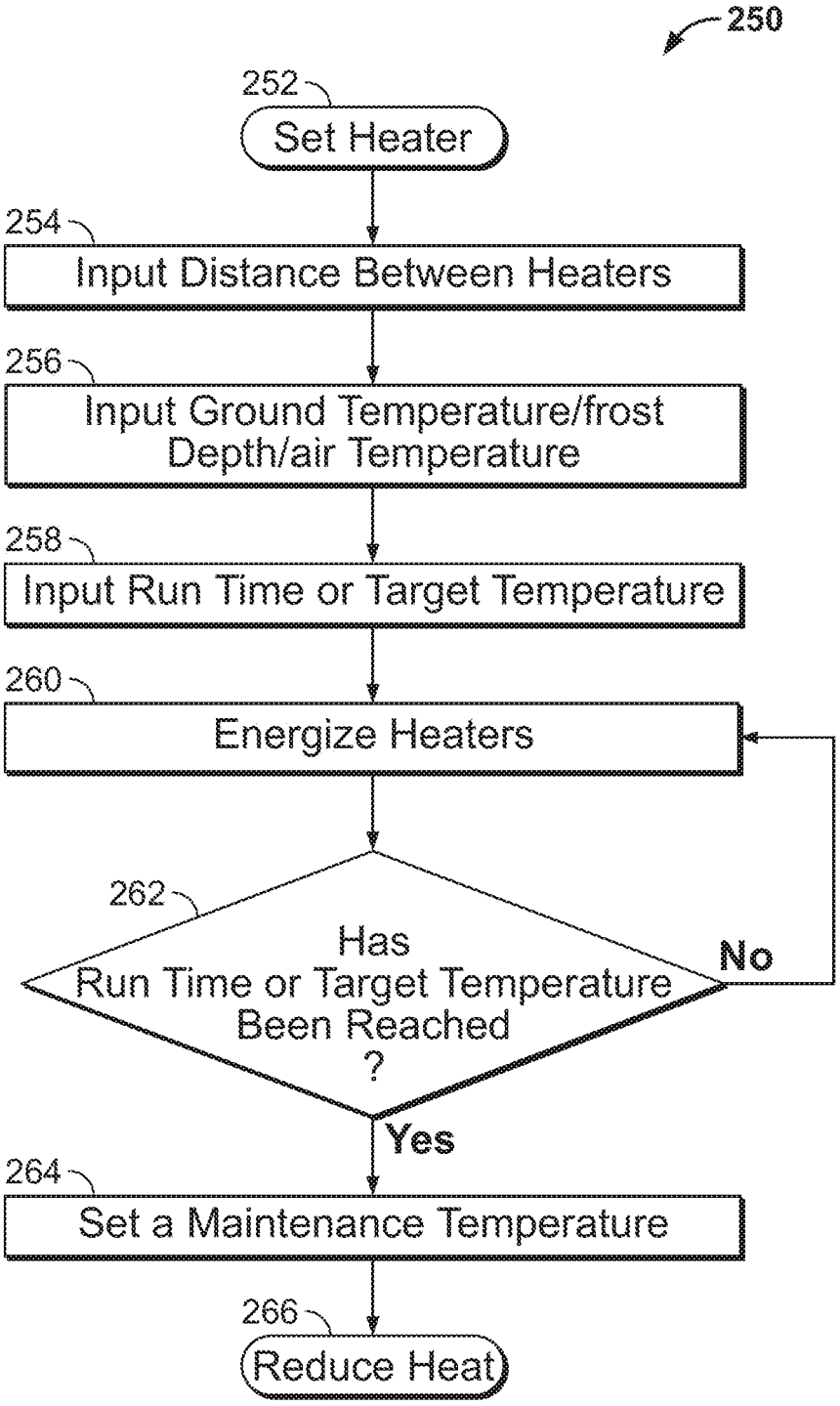
FIG. 16 is flow diagram of a heating control method for the heating system shown for FIG. 1.

FIG. 16 is a flow chart illustrating a heating control method 250 for the heating system 10. In this embodiment, the method 250 includes operations 252, 254, 256, 258, 260, 262, 264, and 266.

The operation 252 is performed to set heaters 12. The operation 254 is performed to input a distance between the heaters 12. The operation 256 is performed to input ground temperature, frost depth, and air temperature. The operation 258 is performed to input run time or target temperature. The operation 260 is performed to energize the heaters 12. The operation 262 is performed to determine whether the run time or target temperature has been reached. The operation 264 is performed to set a maintenance temperature. The operation 266 is performed to reduce the heat setting.

Although the techniques and advantages disclosed above have been described with reference to one heater 12, it will be appreciated that such disclosure is also applicable to the plurality of heaters 12.

Figure 17:
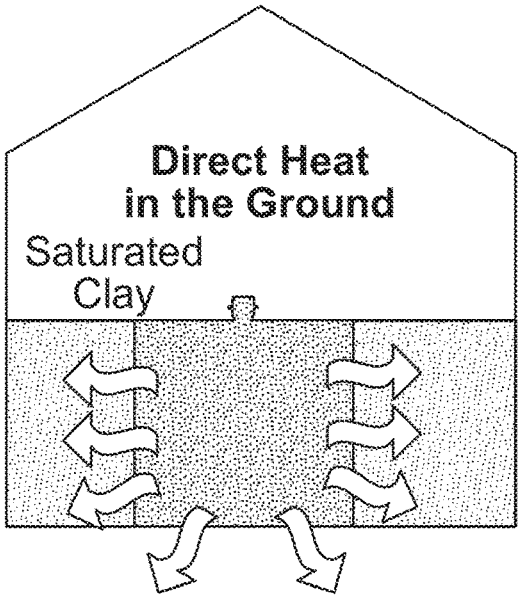
FIG. 17 is a side sectional diagrammatic view of a building with a single heater and heat radiating from the heater in saturated soil according to the principles of the present invention.
Figure 18:
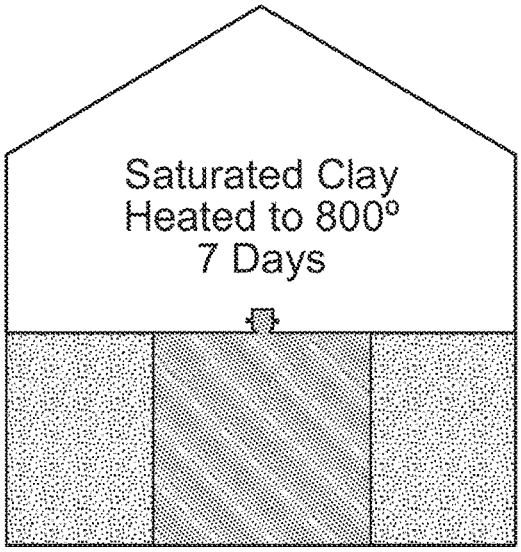
FIG. 18 is a side sectional diagrammatic view of the building, heater and soil of FIG. 17 showing heating.
Figure 19:
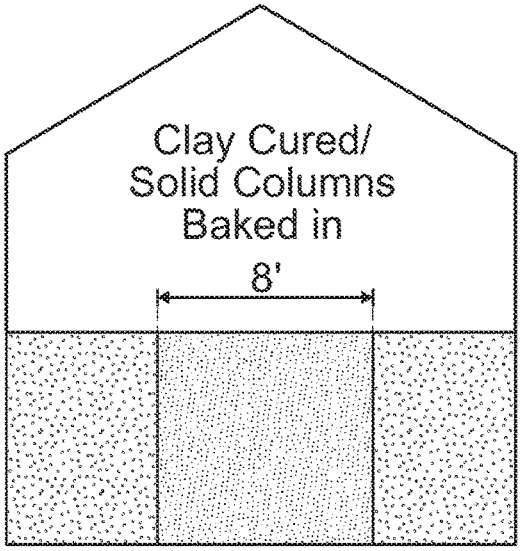
FIG. 19 is a side sectional diagrammatic view of the building, heater and soil of FIG. 17 showing formation of a baked clay column.

As shown in FIGS. 17-19, in another embodiment the heaters 12 are used to heat saturated soil to remove excess water. For such applications, the heater or heaters 12 are augured into the soil. Wet soil is generally relatively soft and easy to bore into. If multiple heaters 12 are utilized, they are located at spaced apart locations so the heat is able to reach a sufficient volume of the soil being treated. The heaters 12 are then brought up to a sufficient temperature to dry the ground. When the ground has been heated a sufficient length of time and a desired amount of water has been removed, the heaters 12 may be turned off and removed.

In addition to removing excess water from the soil, surprising additional benefits from heating were discovered. It has been found that heating soil containing clay may create hardened columns of baked clay with improved load-bearing capacities. Dehydration causes clay particles to bond together more tightly to form a large, hard, dense, dry mass of soil. Referring to FIGS. 17-19, in one application, the soil containing clay was heated at 800 degrees Fahrenheit for seven days. At 212 degrees Fahrenheit, water reaches its boiling point and moisture is driven from the soil. Moreover, as the soil reaches 662 degrees Fahrenheit, chemically combined water of the clay or soil is driven off and the chemical composition is changed. Drying is completed at 932 degrees Fahrenheit and the dehydration and chemical change is complete. Not only was the soil dried to remove the excess moisture, but the area around each of the vertically extending heaters 12 formed hard bake clay. Columns of cured clay approximately 8 feet in diameter and 6 feet deep into the soil were formed. These hard baked/cured clay columns had greater load-bearing than the clay that was not heated. The baked clay columns provide additional load-bearing support to the concrete floor greater than what sand backfill provides. Not only is replacement soil avoided, but the soil has improved characteristics for many uses at construction sites. It has been found that bearing values from the heating and dehydration process increased from less than 75 kPa for soft clays and even less for saturated soft clays and silts to 300-600 kPa for the dehydrated clay soil.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A ground thawing and boring apparatus comprising:

a heat transfer device adapted to transfer heat and to thaw a selected area of frozen ground, the heat transfer device including:

a hollow tubular member having a first end, an opposite second end, and an elongated shaft between the first and second ends;

an electrical connector and a collar positioned at the first end of the hollow tubular member; the electrical connector removably connecting to a power source; the collar removably coupling to a driver radially outward from the electrical connector and around the electrical connector;

an electric heater in the hollow tubular member and connected to the power source through the electrical connector;

a drill bit coupled to the second end of the hollow tubular member;

continuous helical flighting attached to the hollow tubular member above the drill bit and extending outwardly from the hollow tubular member, the drill bit and helical fighting being adapted to have the drill bit drill a hole in the selected area of frozen ground and to have the flighting engage the frozen ground upon rotation of the hollow tubular member in a first direction to lower the hollow tubular member into the selected area of frozen ground and to prevent movement of the hollow tubular member from a predetermined depth; and a controller coordinating heat from the heater, wherein the controller is configured to monitor and adjust temperature of the heater.

2. The apparatus of claim 1, wherein the heater is an electric screw plug heater.

3. The apparatus of claim 1, wherein the helical fighting is secured about the hollow tubular member and spiraling longitudinally along a length of the hollow tubular member.

4. The apparatus of claim 3, wherein the length of the helical flighting is about 15 to 20 inches, and wherein the helical flighting has a cross-dimension of at least 4.5 inches.

5. The apparatus of claim 1, wherein the power source comprises a portable generator providing power to the heat transfer device.

6. The apparatus of claim 1, wherein the controller comprises an interactive portable controller in communication with the heat transfer device and providing control of the heater and displaying characteristics of the apparatus.

7. The apparatus of claim 1, wherein the first end of the hollow tubular member has a threaded connection to removably secure the heater within the hollow tubular member.

8. The apparatus of claim 1, comprising a cable connected to the heater comprising a thermocouple and three insulated wires surrounded by an outer cover.

9. The ground thawing and boring apparatus according to claim 1, wherein the electrical connector and the collar are coaxial and wherein the electrical connector is radially inward from the collar.

10. A ground thawing system comprising:

a plurality of spaced apart heat transfer devices adapted to transfer heat and to thaw a selected area of frozen ground, each of the heat transfer devices including:

a hollow tubular member having a first end, an opposite second end, and an elongated shaft between the first and second ends;

an electrical connector and a collar positioned at the first end of the hollow tubular member; the electrical connector removably connecting a power source; the collar removably coupling to a portable driver;

a drill bit coupled to the second end of the hollow tubular member;

continuous helical flighting attached to the hollow tubular member proximate the drill bit and extending outwardly from the hollow tubular member, the drill bit and the helical fighting being adapted to have the drill bit drill a hole in the selected area of frozen ground and have the helical flighting engage surrounding frozen soil and lower the heat transfer device into the frozen ground, the helical flighting engaging the surrounding frozen ground and preventing movement of the at least one tubular heat transfer device from the predetermined depth; and an electric heater in the hollow tubular member and connected to the power source through the electrical connector;

a controller coordinating heat from the electric heater, wherein the controller is configured to monitor and adjust temperature of the electric heater.

11. The ground thawing system according to claim 10, wherein the electrical connector and the collar are coaxial and wherein the electrical connector is radially inward from the collar.

12. The ground thawing system according to claim 10, wherein the plurality of the tubular heat transfer devices are spaced apart in a predetermined pattern and wherein the controller coordinates and controls heating of the spaced apart heat transfer devices.

13. A method of removing moisture from a selected area of wet soil comprising:

providing at least one tubular heat transfer device, the at least one tubular heat transfer device having a drill bit at a bottom of the tubular heat transfer device and helical fighting above the drill bit and along a length of the at least one tubular heat transfer device in an operating position, an electric heater in the at least one tubular heat transfer device, and a power coupling and a collar at a top of the heat transfer device in the operating position;

removably attaching the collar to a driver around the power coupling; and drilling a hole with the drill bit into the selected area of wet soil to a predetermined depth, wherein the predetermined depth is at least a depth of unwanted moisture while simultaneously rotating the at least one tubular heat transfer device so the helical fighting engages surrounding wet soil and lowers the at least one tubular heat transfer device in the hole to the predetermined depth, the helical fighting engaging the surrounding wet soil and preventing movement of the at least one tubular heat transfer device from the predetermined depth;

activating the heater and heating the at least one tubular heat transfer device and allowing the heat to travel along a length of the at least one tubular heat transfer device;

applying, for a selected period of time, heat from the at least one tubular heat transfer device to surrounding soil for drying the selected area of wet soil until a desired amount of the water is removed; and removing the at least one tubular heat transfer device from the soil when heating is no longer needed.

14. The method according to claim 13, further comprising heating clay in the soil until the clay is baked to form a load-bearing column surrounding the heat transfer device.

15. The method of claim 13, wherein the heat transfer device is disconnected from the driver after the heat transfer device is driven into the wet soil.

16. The method of removing moisture from a selected area of wet soil according to claim 13, wherein the power coupling and the collar are coaxial and the power coupling is radially inward from the collar.

* * * * *